US006533133B2

(12) United States Patent
Liu

(10) Patent No.: US 6,533,133 B2
(45) Date of Patent: Mar. 18, 2003

(54) TEST TUBE RACK WITH INSERTING STRUCTURE

(76) Inventor: Jun-Tai Liu, P.O. Box No.6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/859,598

(22) Filed: May 18, 2001

(65) Prior Publication Data

US 2002/0170867 A1 Nov. 21, 2002

(51) Int. Cl.[7] ..... A47F 7/00
(52) U.S. Cl. ..... 211/74; 422/99; 422/104
(58) Field of Search ..... 211/74, 60.1; 422/104, 422/99

(56) References Cited

U.S. PATENT DOCUMENTS 3,142,385 A * 7/1964 Kahlenberg ..... 211/74
3,375,934 A * 4/1968 Bates
3,643,812 A * 2/1972 Mander et al. ..... 211/74
3,709,429 A * 1/1973 McKenzie et al. ..... 211/74 X
4,124,122 A * 11/1978 Emmitt ..... 211/74
4,963,493 A * 10/1990 Daftsios ..... 422/104 X
5,080,232 A * 1/1992 Leoncavallo et al. ..... 211/74 X
5,133,939 A * 7/1992 Mahe ..... 422/104
5,725,109 A * 3/1998 Moulton et al. ..... 211/73
5,993,745 A * 11/1999 Laska ..... 422/104
5,996,818 A * 12/1999 Boje et al. ..... 211/74

* cited by examiner

*Primary Examiner*—Robert W. Gibson, Jr.
(74) *Attorney, Agent, or Firm*—Troxell Law Office PLLC

(57) ABSTRACT

A test tube rack a top tray bridging and jointing a bottom tray set, having several rows of inserting holes for and receiving cups for test tubes. Through holes are disposed on a flexible sandwich plate on the upper portion of the bottom tray set. When inserted, the test tubes may be depressed or placed gently with various heights for convenient selecting, temporary storing or further conducting the screening and distinguishing tests.

3 Claims, 4 Drawing Sheets

TEST TUBE RACK WITH INSERTING STRUCTURE

BACKGROUND OF THE INVENTION

1) Field of the Invention

The invention herein is a test tube rack with the improved inserting structure, more especially a test tube inserting structure for a test tube rack. As the test tube is being put into the inserting holes, the height of the test tube placed gently will be higher than that of the test tube depressed gently at the tube opening to make the bottom of the test tube push through the holding hole to fall into the receiving cup. Therefore, by the different heights of the test tubes on the same try, the selecting, temporary storing or the screening and distinguishing of the test tubes can be conducted.

2) Description of the Prior Art

During the process of medical inspections, various bi-chemical operations or experiments, many test tubes will be examined. Therefore, the test tubes need to be placed individually to stand on the specific test tube rack for achieving the purpose of resuming, placing or arranging.

However, the conventional structure of the test tube rack, as shown in FIG. 1, consists of a metal mesh basket (10) with basket openings (11) on the top; every mesh opening (12, 13) can hold one test tube (20, 21). The examiner can select and pick up the test tubes to complete the examination for all the test tubes one after the other. During the examination, if the examiner can step by step and randomly inspect the test tubes consecutively, it is easy to distinguish which test tube (20, 21) is under examination, which one is still waiting for examination, which ones passed the examination and which ones didn't. However, during the operation, the operator often comes across unexpected situations such as receiving a phone call or being asked by the colleagues to discuss cases. Thus the procedure of examination is interrupted. Then, as the examiner returns to examine the test tubes, he may easily forget which test tube (20, 21) he was working on since the test tubes (20, 21) stand in the same basket, belong to the same group, with the same type, examining purpose and height tend to get confused. Without initial and special distinguishing for the examined and unexamined test tubes, or without consistent order for randomly picking up, the confusing situation can't be prevented.

Therefore, in operation, the examiner usually uses two metal mesh baskets (10) for conducting the tests. One basket for test tubes to be examined and the other for placing the examined ones to obviously separate the latter from the former so as to allow the examiner to return after leaving temporarily from the job and clearly distinguish the test. However, using this method, two metal mesh baskets (10) are always required, which not only becomes troublesome for preparation, but also inconvenient since for occasions requiring the carrying of the test tube rack to other medical treating locations or bio-chemical inspecting stations for doing short-noticed examination of lesser quantities, for easy carrying, usually only one metal mesh basket will be taken. Therefore, the original habit of examining two distinguishable baskets will be broken and not be substantially maintained. In order to distinguish the test tubes (20, 21) of the examined, the unexamined, the passed or not, the examiner may leave some of the available mesh openings (12, 13) empty so as to use the gaps for distinguishing and separating the test tubes (20, 21) in the basket into two groups of the examined and unexamined groups or the passed or not groups. Although this method can separate the test tubes (20, 21) in the same basket, the available positions in the basket will be sacrificed and also reduce the number of examinable test tubes (20, 21) inside every basket and fail to achieve the examination quantity that each basket in every group is supposed to have.

In view of the mentioned various shortcomings of the conventional rack structure for the test tubes, the inventor of the invention herein researched enthusiastically for the improvement, after going through the process full of hardship in making innovation, finally culminated in the invention herein.

SUMMARY OF THE INVENTION

Therefore, the invention herein is a test tube rack with improved inserting structure having, between the transversely superposed tray bodies, a flexible sheet with holding holes for the bodies of the inserted test tubes. The flexible sheet is made of flexible material having holding holes in the shapes of starlike radiation with the diameters a little smaller than that of the bottom of the test tubes and are capable of supporting the test tubes and the weight of the liquid inside the test tubes. After being put into the inserting holes, the heights of the bodies of test tubes placed gently will be higher than that of the test tubes being depressed gently on the tube openings and pushed through the holding holes into the receiving cups. Therefore, by the different heights of the test tubes placed in the same tray, the test tubes under examination can be selected, temporarily stored, screened or distinguished.

Another objective of the invention herein is to have narrow seams or grooves, mounted downwards on the two side walls adjacent to the side rims of the superposed top tray and bottom tray set, for marking labels to be conveniently inserted to indicate the examination items, dates, etc. of the test tubes in that tray so as to eliminate the use of glue or stapler for pasting or hanging labeled notes on the test tube rack.

To enable a further understanding of the detail structure and principles of the application of the invention herein, the brief description of the drawings below is followed by the detailed description of the preferred embodiment.

DETAILED DESCRIPTION OF THE PREFERRED EMBODIMENTS

Figure 1:
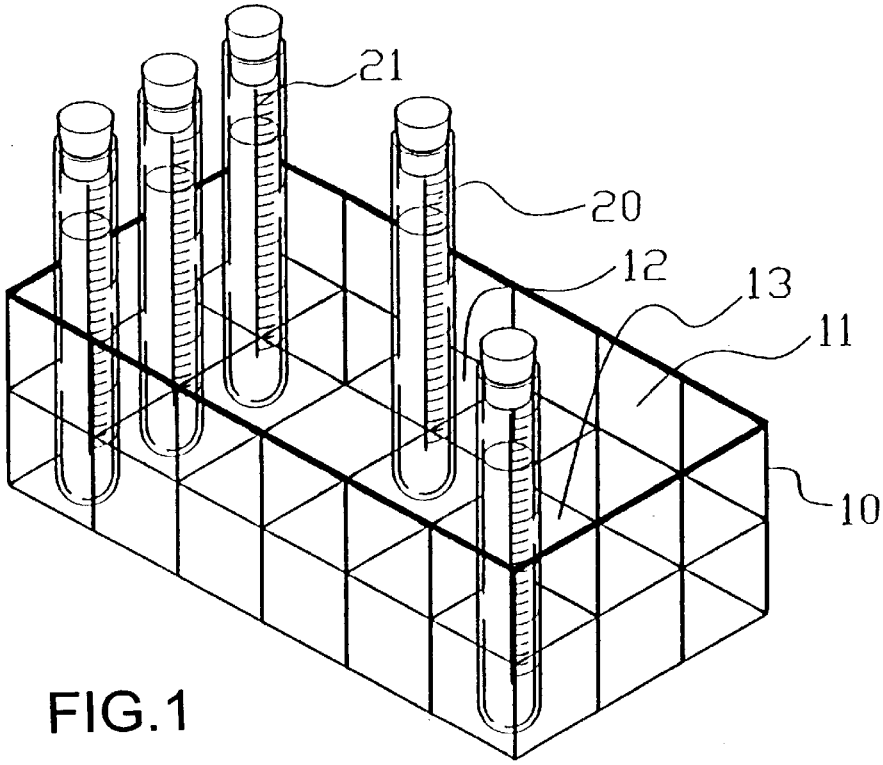
FIG.1 Prior Art
FIG. 1 is a pictorial drawing of the structure of the conventional test tube rack.
Figure 2:
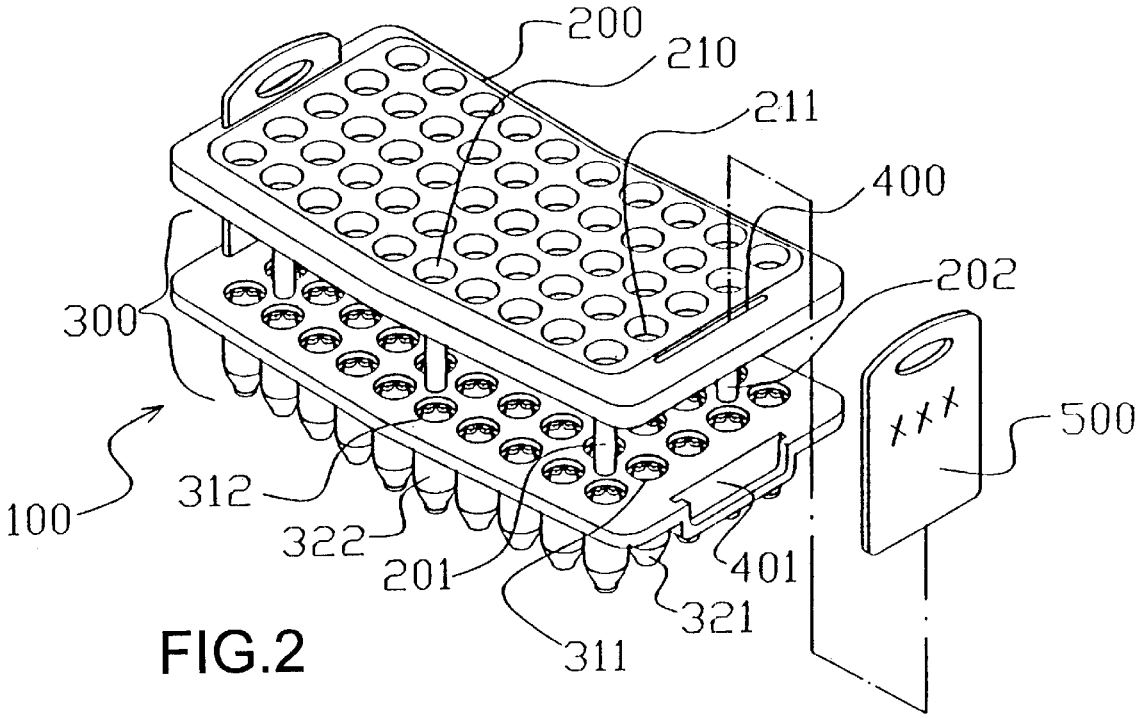
FIG. 2 is a pictorial drawing of the entire test tube rack of the test tube rack with the improved inserting structure of the invention herein.

Referring to FIG. 1, the shortcomings of structure of the conventional test tube rack mentioned above will not be described again.

Figure 3:
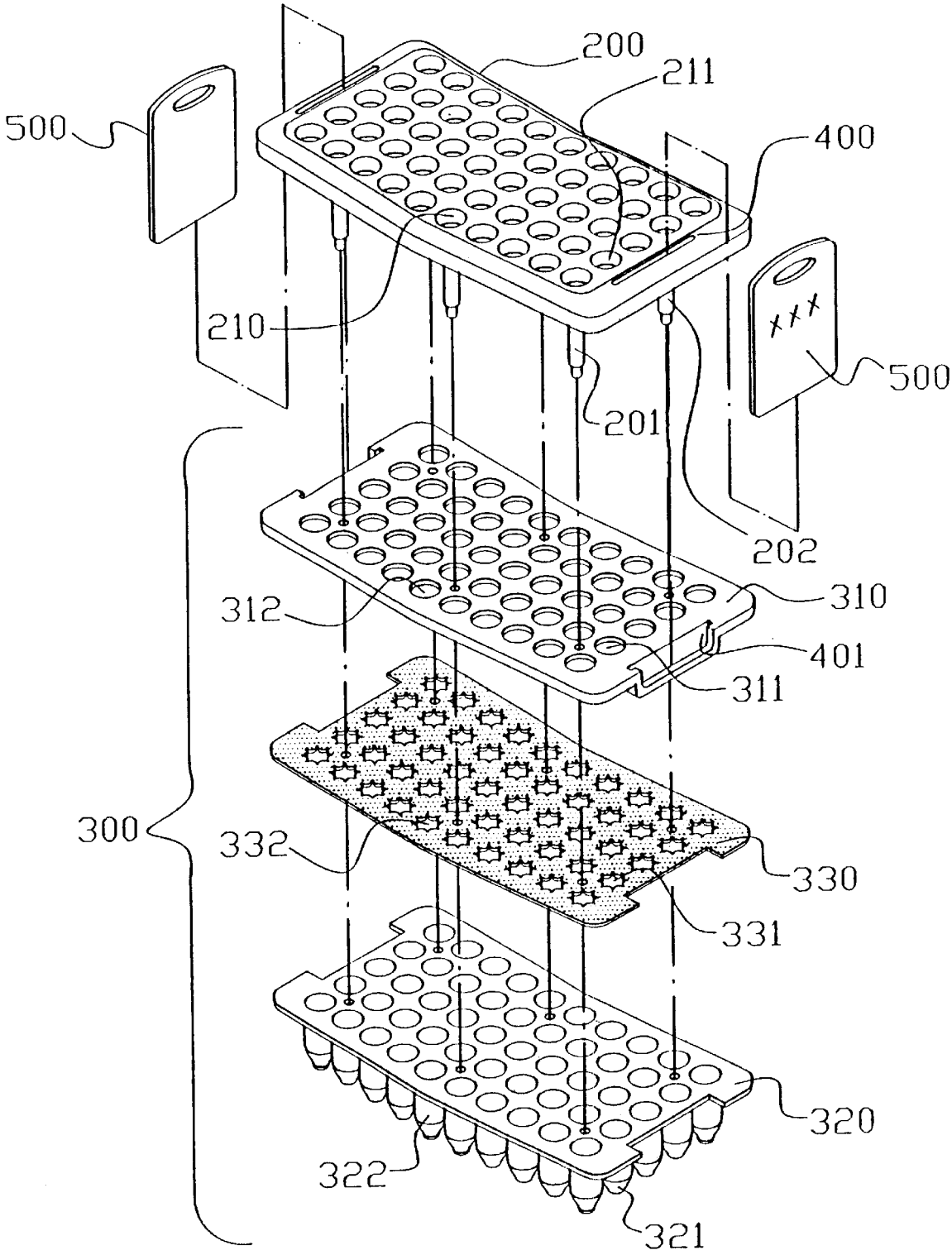
FIG. 3 is a pictorial exploded drawing of the test tube rack with the improved inserting structure of the invention herein.
Figure 4:
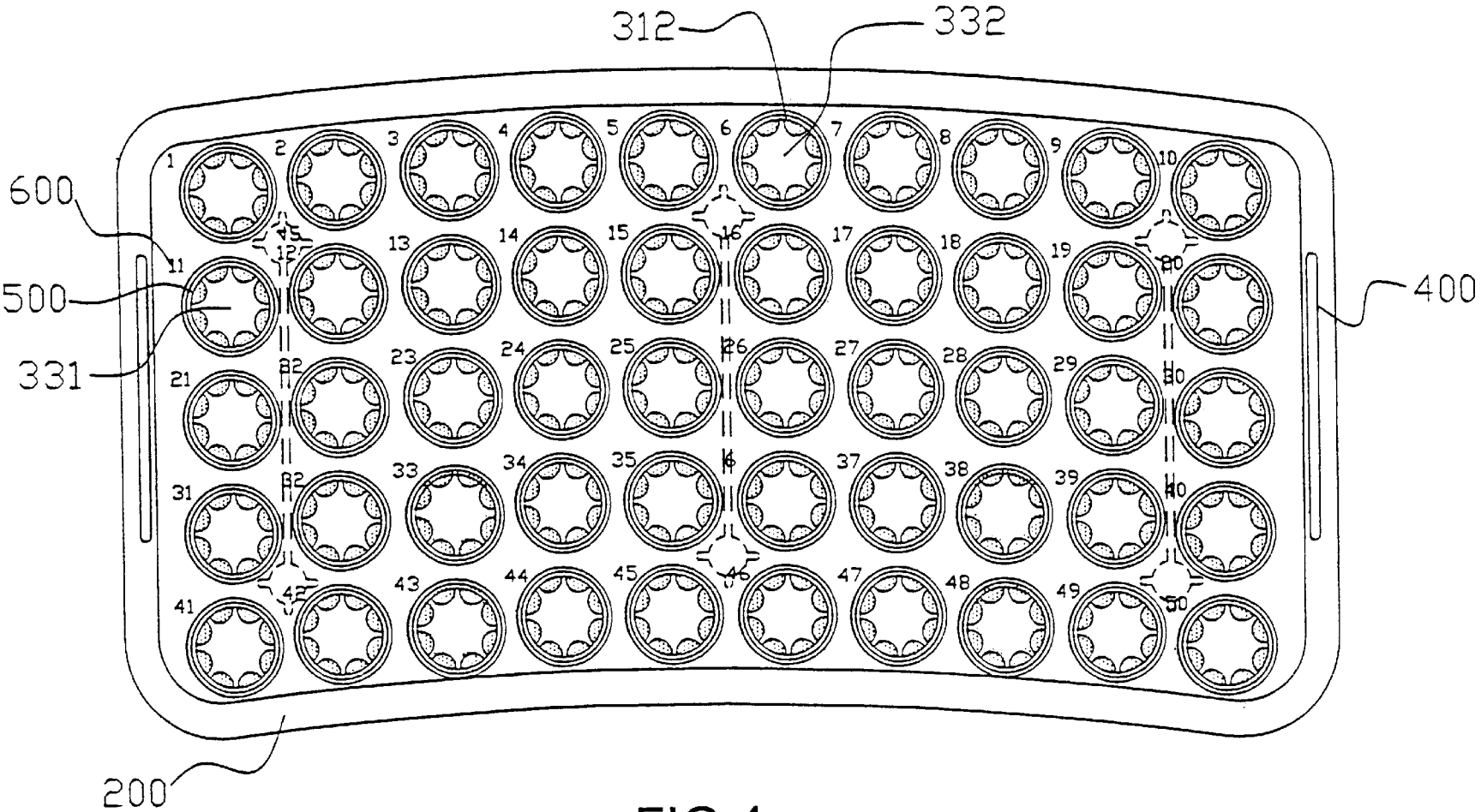
FIG. 4 is a drawing of the top view of the test tube rack with the improved inserting structure of the invention herein.
Figure 5:
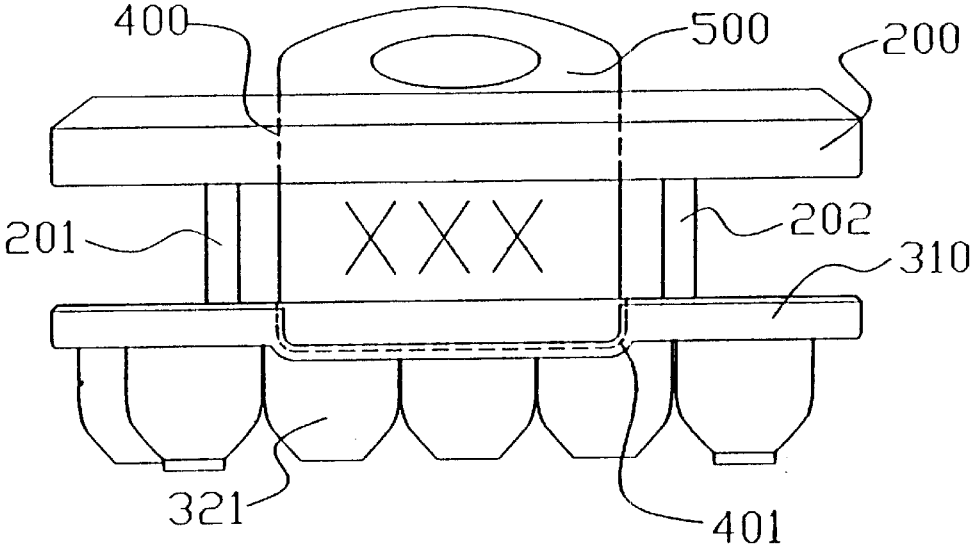
FIG. 5 is a drawing of the side view of the test tube rack with the improved inserting structure of the invention herein.

Referring to FIGS. 2–5, is a pictorial drawing of the entire test tube rack with the improved inserting structure of the invention herein, FIG. 3 is a pictorial exploded drawing, FIG. 4 is a top view drawing and FIG. 5 is a side view drawing. The invention herein is a test tube rack with improved inserting structure which comprises a test tube rack (100) having, extending from the bottom of a top tray (200), several perpendicular rods (201, 202) distributed in proper distance to insert into and bridge vertically a bottom tray set (300). Several rows of inserting holes (210, 211) for the test tubes are formed on the top tray (200) surface. Through holes (311, 312) with the apertures aligned vertically relative to the inserting holes (210, 211) for the test tubes are disposed on the flexible sandwich plate on the top side of the bottom tray set (300). The lower portion of the bottom tray set (300) has receiving cups (321, 322) with the apertures aligned relative to the through holes (311, 312) to allow the bottoms of the test tubes (not shown in the FIGs.; referring to FIG. 1 to FIG. 4) to enter and stand inside the receiving cups (321, 322) through the inserting holes (210, 211) and the through holes (311, 312). The bottom tray set (300) is formed by inserting and superposing a flexible sandwich plate (310), a tray set of receiving cups (320) and a piece of flexible sheet (330). The through holes (311, 312) in the flexible sandwich plate (310) with the top portion of the flexible sandwich plate (310) bridging and jointing the bottom of the said top tray (200). The flexible sheet (330) is superposed between the flexible sandwich plate (310) and the tray set of receiving cups (320) and has starlike holding holes (331, 332) therein aligned relative to the through holes (311, 312). The center diameters of the holding holes (331, 332) are smaller than that of both the inserting holes (210, 211) for the test tubes and the through holes (311, 312) on the flexible sandwich plate (310). Around all inserting holes (210, 211) on the surface of the top tray (200), as shown in FIG. 4, order numbers (600) can be formed by carving or printing to help the operator distinguish the arrangement positions and quantities. Narrow seams (400) and grooves (401) on the two side walls adjacent to the side rims of the top tray (200) and bottom tray set (300), are for marking labels (500) to be inserted to indicate the examination items of the test tubes in that tray.

Figure 6:
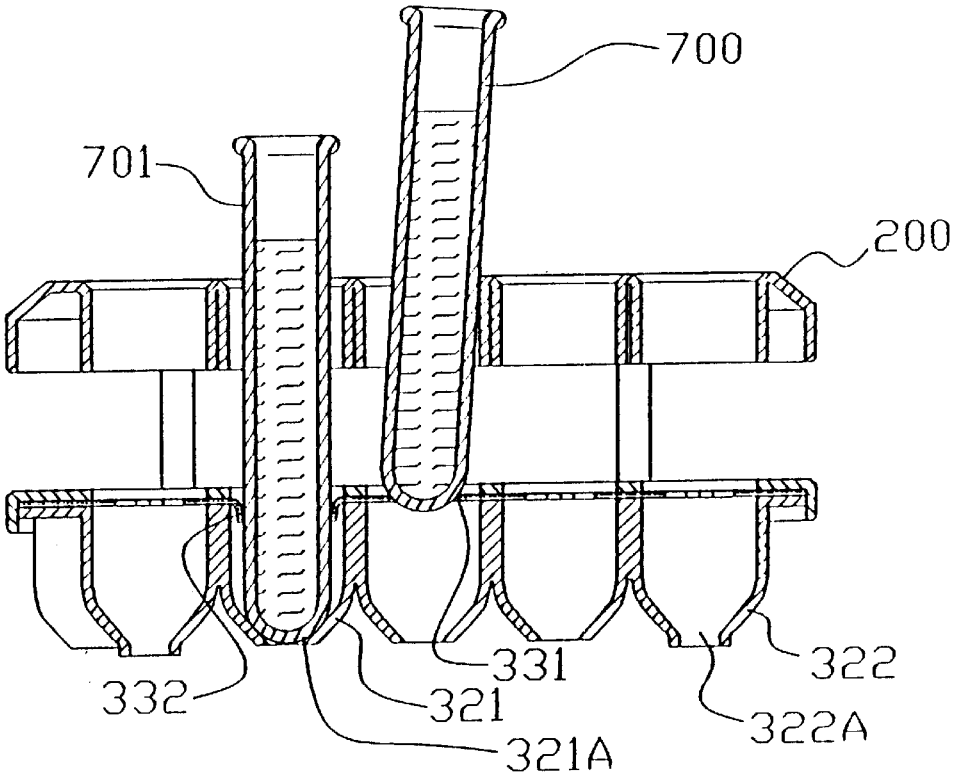
FIG. 6 is a drawing of the sectional view of the test tube rack with the improved inserting structure of the invention herein in application.

In application, as shown in FIG. 6, as the test tubes (700) are inserted, by choosing to gently place the tube bodies, the bottoms of the test tubes (700) will not go through the holding holes (331) but be blocked and supported high by the hole rims of the holding holes (331, 332). By gently depressing the test tubes (701), the bottoms of the test tubes (701) will push through the holding holes (331, 332), into the receiving cups (321, 322) and lower the height test tubes (701). Therefore, putting the test tubes (700, 701) at various heights helps in selecting, temporary storing, screening and distinguishing the test tubes under examination. Since the natural reaction of people at the moment of receiving unexpected notice, a telephone call, or leaving the working seat, will cause inattention, the examiner will more likely put the picked and unexamined test tube (700) gently back to the mesh opening instead of spending time to push the test tube (700) back to the lower position. For the test tube (701) placed without distraction, the examiner will carefully and naturally push them to the lower positions. Thus, the examiner knows for sure that he can still clearly distinguish which test tube (700) he should start with to continue the work with almost no chance of being confused by the sequential order of the examination. Centers of the bottoms of the receiving cups (321, 322) extending downwards from the bottom of the tray set (320) of the receiving cups can have holes (321A, 322A) for draining purposes. In summation of the foregoing sections, the invention herein of a test tube rack with an improved inserting structure, is more convenient for selecting, temporary storing or conducting screening of test tubes, and is substantially superior to the conventional test tube rack in terms of enabling the clear organization and examination of test tubes.

What is claimed is:

1. A test tube rack comprising:

a) a top tray having a plurality of inserting holes each having a first cross-sectional dimension, the top try having at least one edge portion with a slot therethrough;

b) a bottom tray set having a plurality of receiving cups, the plurality of receiving cups in alignment with the plurality of inserting holes so as to receive bottoms of test tubes inserted into the test tube rack;

c) a plurality of rods connecting the top tray and the bottom tray set such that the top tray is spaced from the bottom tray set, the plurality of rods being located within outermost edges of the top tray and bottom tray set;

d) a flexible plate including a flexible sheet having a plurality of holding holes therein, the plurality of holding holes in alignment with the plurality of inserting holes, each of the holding holes having a cross-sectional dimension smaller than the cross-sectional dimension of the inserting holes, the flexible plate mounted on the bottom tray set such that the flexible sheet is between the flexible plate and the bottom tray set, the flexible plate having at least one edge portion with a groove therein; and, e) a marking label removably engaging the slot and the groove.

2. The test tube rack of claim 1 further comprising holes in bottoms of the receiving cups.

3. The test tube rack of claim 1 further comprising indicia on the top tray adjacent to each inserting hole.

* * * * *